US005267582A

United States Patent [19]

Purtilo

[11] Patent Number: 5,267,582

[45] Date of Patent: Dec. 7, 1993

[54] WASH ARM CONSTRUCTION

[75] Inventor: Dennis L. Purtilo, Newton, Iowa

[73] Assignee: Maytag Corporation, Newton, Iowa

[21] Appl. No.: 822,876

[22] Filed: Jan. 21, 1992

[51] Int. Cl.[5] ..... A47L 15/22

[52] U.S. Cl. ..... 134/180; 239/251; 239/553.5

[58] Field of Search ..... 134/144, 176, 179, 180, 134/181; 239/251, 262, 553, 553.5

[56] References Cited

U.S. PATENT DOCUMENTS

| | | | |
|---|---|---|---|
| D. 212,121 | 8/1968 | Tuthill et al. . | |
| 1,502,863 | 7/1924 | Merseles | 134/181 X |
| 1,620,671 | 3/1927 | Merseles . | |
| 1,645,814 | 10/1927 | Miller . | |
| 2,644,718 | 7/1953 | Richard . | |
| 2,673,763 | 3/1954 | Dunn | 239/553.3 X |
| 3,107,860 | 10/1963 | Umbricht . | |
| 3,160,164 | 12/1964 | Constance et al. | 134/176 |
| 3,253,784 | 5/1966 | Long et al. . | |
| 3,285,779 | 11/1966 | Dunham . | |
| 3,288,372 | 11/1966 | Cushing | 239/251 |
| 3,362,645 | 1/1968 | Clark | 239/251 |
| 3,384,098 | 5/1968 | Swetnam . | |
| 3,415,259 | 12/1968 | Noren et al. | 134/180 |
| 3,586,011 | 6/1971 | Mazza | 134/183 X |
| 3,918,644 | 11/1975 | Platt et al. | 239/251 X |
| 3,941,139 | 3/1976 | Spiegel | 134/176 |
| 3,960,328 | 6/1976 | Archambault | 239/264 |
| 4,096,872 | 6/1978 | Herbst et al. | 134/182 X |
| 4,210,285 | 7/1980 | Dicken, Jr. et al. | 239/251 |
| 4,418,868 | 12/1983 | Gurubatham et al. | 239/251 X |
| 4,509,687 | 4/1985 | Cushing | 239/251 X |

FOREIGN PATENT DOCUMENTS

| | | | |
|---|---|---|---|
| 1007258 | 10/1965 | United Kingdom | 239/553.3 |

*Primary Examiner*—Philip R. Coe

*Attorney, Agent, or Firm*—Zarley, McKee, Thomte, Voorhees, & Sease

[57] ABSTRACT

A wash arm construction for a dishwasher includes an elongated wash arm having a hollow spray cavity contained therein. Within the spray cavity are one or more subcompartments which have inlet openings providing communication from the spray cavity into the subcompartment. A first group of these spray openings is in direct communication with the spray cavity, and a second group of openings is in direct communication with the subcompartments. The size of the openings to the subcompartments from the spray cavity cause a lower spray pressure to be achieved within the subcompartments than is achieved in the spray cavity.

12 Claims, 3 Drawing Sheets

WASH ARM CONSTRUCTION

BACKGROUND OF THE INVENTION

The present invention relates to a wash arm construction.

A typical dishwasher includes one or more elongated wash arms which rotate about a vertical axis located at their longitudinal midpoint. Each arm is hollow and includes a plurality of apertures spaced apart from one another along the length of the arm. Pressurized cleaning fluid or water is introduced to the cavity within the arm, and is sprayed outwardly through the various spray apertures along the length of the arm.

During rotation of the arm, the distance a particular spray hole in the arm travels increases significantly the further its distance from the center of rotation. Because the travel distance increases farther away from the rotational center of the arm, the velocity of the spray holes at various locations on the arm is also significantly different, with the greater speeds being farther from the rotational axis of the arm. Therefore, a jet of washing fluid from a spray hole at the end of the arm impacts a dish for a much shorter period of time than a jet from a spray hole nearer to the center of the arm. In order to get sufficient washing fluid to the dishes located adjacent the outer end of the arm, the fluid pressure in the arm must be fairly high to achieve good washing performance. If this high pressure is used, the spray holes located closer to the pivotal axis of the arm are allowed to create sprays which impact dishes for a long enough period of time to cause the dishes to move. Dish movement frequently occurs near the center of the pivotal axis in prior art machines.

In many dishwashers, the dishes which are most likely to be moved by high pressure spray are generally located in the area which is approximately half way between the pivotal axis of the arm and the outer end of the arm. Therefore, it is desirable to provide a spray arm which has the capability of varying the pressures at the various spray holes so as to decrease the pressures in the areas where the fluid jets are likely to impact and move a dish. Reducing the fluid pressure in these areas minimizes dish movement while still maintaining the higher pressures at the outer ends of the arm where needed.

SUMMARY OF THE INVENTION

Therefore, a primary object of the present invention is the provision of an improved wash arm construction for use in a dishwasher.

A further object of the present invention is the provision of an improved wash arm construction which has the capability of varying the fluid pressures at different spray holes along the length of the wash arm.

A further object of the present invention is the provision of an improved wash arm construction which is capable of varying the pressures at the various spray holes in the wash arm, without the use of any moving parts.

A further object of the present invention is the provision of an improved wash arm construction which is simple in construction, efficient to manufacture, and reliable in operation.

The present invention achieves these objects by providing an elongated wash arm having an elongated spray compartment enclosed therein. Along the length of the compartment are a plurality of spray apertures which are spaced apart from one another in a line which extends along substantially the entire length of the wash arm. Within the compartment are one or more subcompartments which include inlet openings for permitting fluid to pass from the larger spray compartment into the subcompartments. Each of the subcompartments is in communication with one or more spray apertures so that fluid can spray out of the subcompartment through the spray apertures.

An inlet is provided in the wash arm for permitting the introduction of washing fluid or water under high pressure. The water or washing fluid fills the larger compartment within the wash arm and also passes through the inlet openings of the subcompartments and fills the subcompartments. Because the washing fluid is under pressure, it exits out through the spray openings in the wash arm. The spray coming out of the spray openings in communication with the subcompartments is at a lower pressure than the spray coming out of the apertures in communication with the larger compartment. This is because the fluid pressure within the subcompartment is reduced as a result of the restricted size of the inlet openings to the subcompartments.

The location of the subcompartments can be varied without detracting from the invention. However, in most dishwashers, the dishes which are most likely to be moved by high pressure spraying are located in the area which is intermediate the pivotal axis of the wash arm and the outer end of the wash arm. Therefore, it is desirable to place the subcompartments in this intermediate area so that the spray upon the dishes in this area is of a reduced pressure.

DETAILED DESCRIPTION OF THE PREFERRED EMBODIMENT

Figure 1:
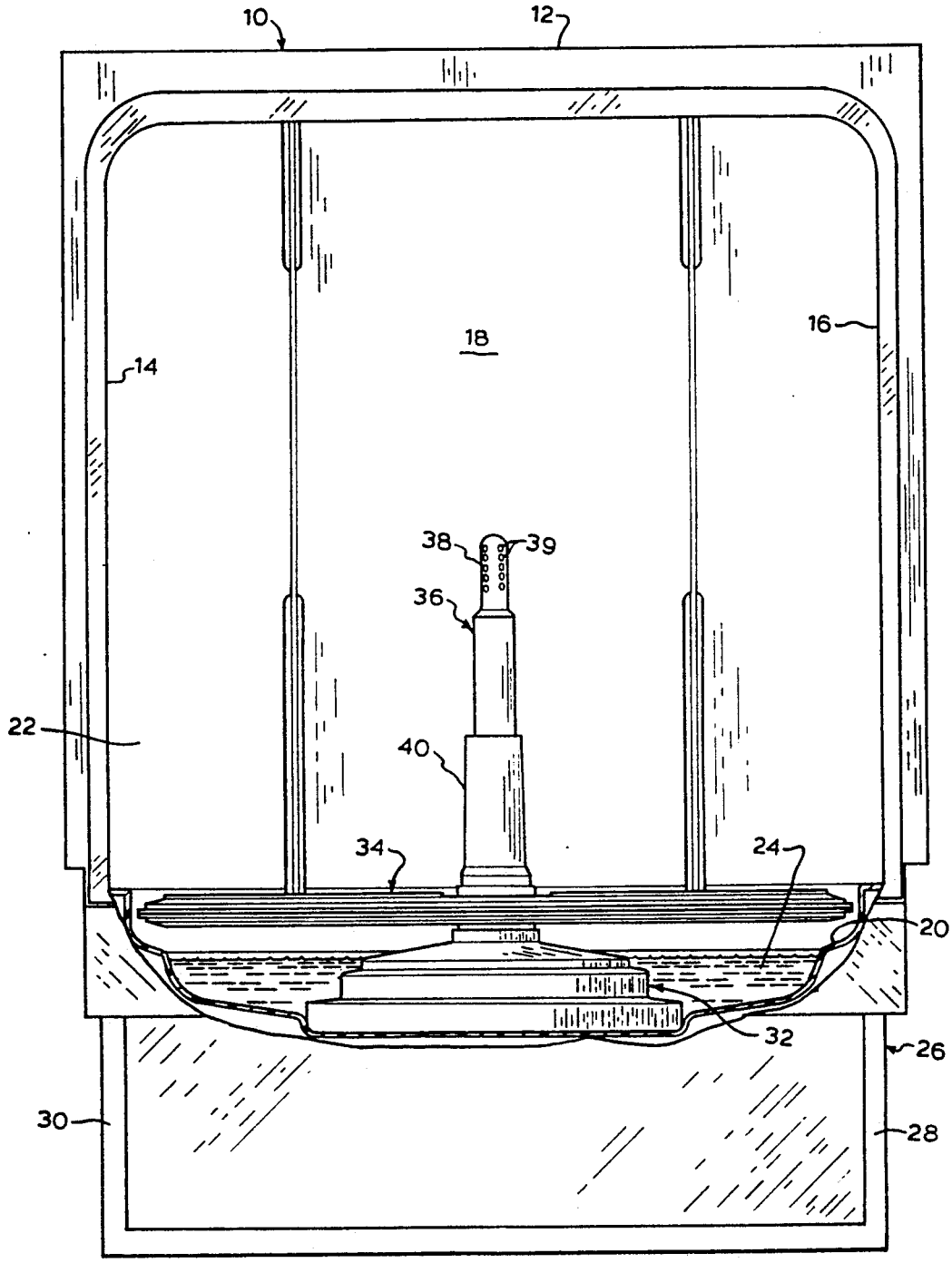
FIG. 1 is a front elevational view of a dishwasher showing a portion of the front wall broken away.

Referring to the drawings, the numeral 10 generally designates a dishwasher tub utilized in the dishwasher of the present invention. Tub 10 includes a top wall 12, sidewalls 14, 16, a rear wall 18, and a bottom wall 20, which define a washing cavity or chamber 22 for washing dishes. Typical dishwashers operate by having a predetermined amount of water or washing fluid 24 contained within the lower portion of the washing cavity 22.

Dishwasher tub 10 is supported on a tub support frame 26 having support sidewalls 28, 30.

Figure 2:
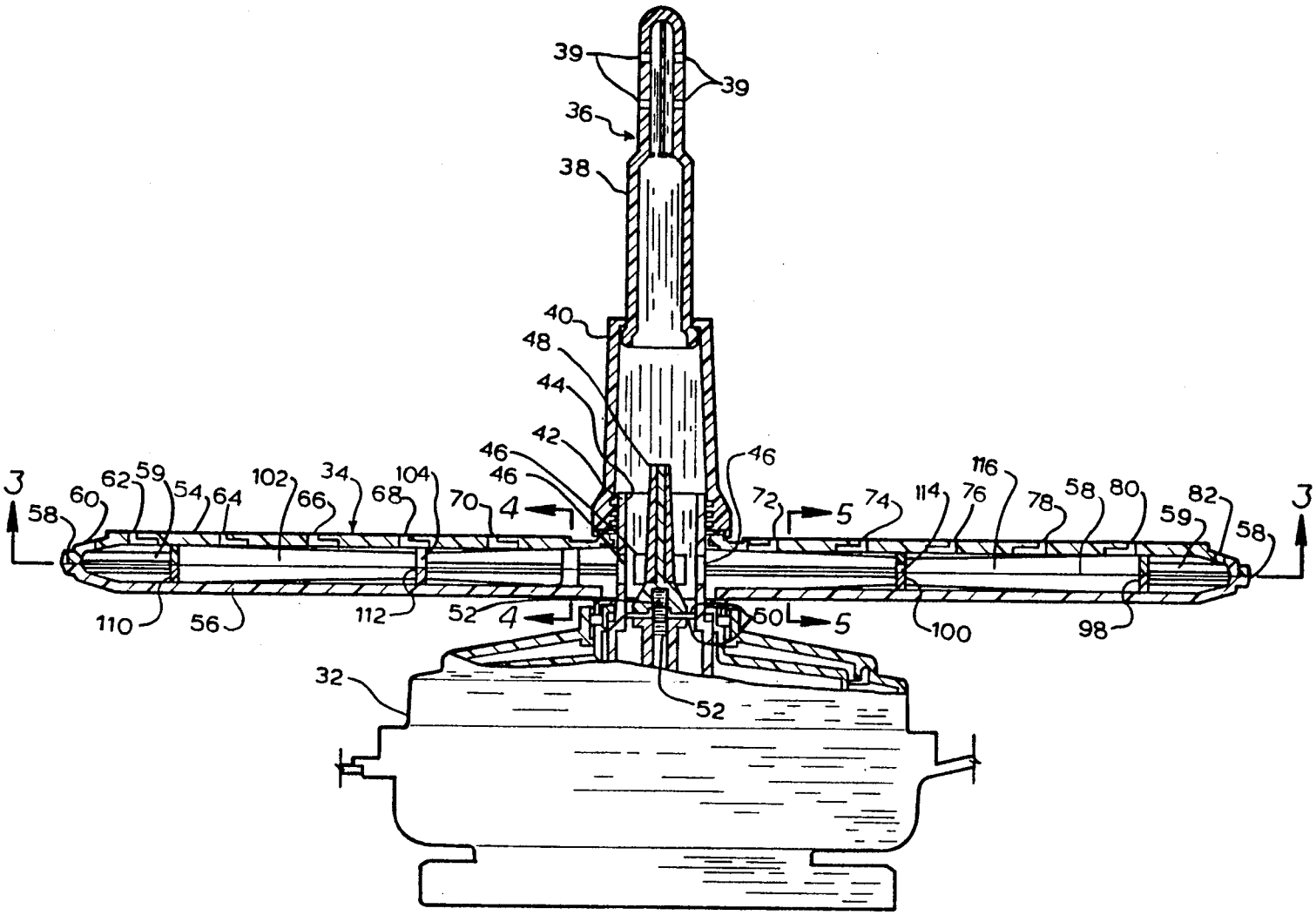
FIG. 2 is a view similar to FIG. 1, but showing the wash arm and the nozzle in section.
Figure 3:
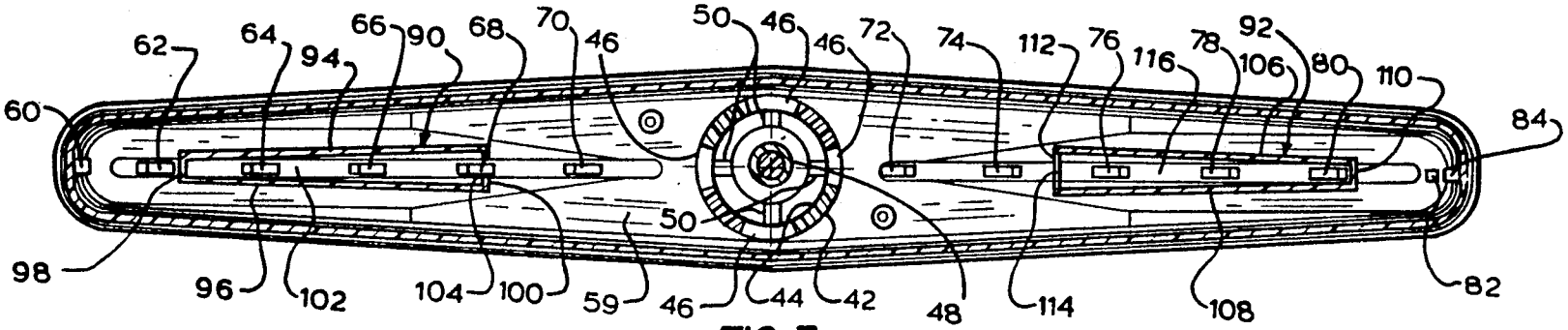
FIG. 3 is a sectional view taken along line 3—3 of FIG. 2.
Figure 5:
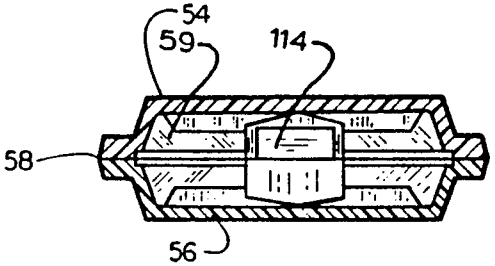
FIGS. 4 and 5 are sectional views taken along lines 4—4 and 5—5 of FIG. 2.
Figure 4:
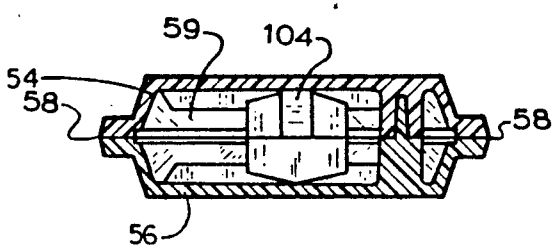

Mounted within the washing chamber or cavity 22 is a recirculation pump 32 which rotatably supports a wash arm 34 and a telescoping nozzle assembly 36. Nozzle assembly 36 comprises an upper nozzle member 38 having a plurality of radially directed nozzle spray apertures 39. Upper nozzle member 38 is telescopically received within lower nozzle member 40 which in turn is operatively attached to a pump outlet pipe 42 extending upwardly from pump 32. Outlet pipe 42 includes an internal hollow throat 44 which is provided with a plurality of radial holes 46 in its outer cylindrical surface. An elongated nut 48 is threaded over a bolt 52 which is attached to the pump 32. Pump outlet pipe 42 includes a plurality of spokes 50 (FIGS. 2 and 3) which extend beneath nut 48 and are attached to pump 32 by means of threaded attachment of nut 48 to bolt 52.

Upper nozzle member 38 is telescopically received within lower nozzle member 40. When the dishwasher is not operating, the upper nozzle 36 is retracted downwardly from its extended position shown in FIG. 2. However, when fluid pressure is introduced to the interior of nozzle assembly 36, the upper nozzle member 38 extends upwardly to its extended position shown in FIG. 2, and washing fluid is sprayed outwardly through the nozzle spray apertures 39.

Wash arm 34 is comprised of an upper plate 54 and a lower plate 56 which are made of plastic and which are joined together by a weld joint 58 in spaced relationship to one another so as to create a spray cavity 59 therebetween. A plurality of spray apertures 60, 62, 64, 66, 68, 70, 72, 74, 76, 78, 80, 82, and 84 are provided in upper plate 54 for permitting washing fluid to be sprayed outwardly from the spray cavity 59. Located within spray cavity 59 are a first internal box 90 and a second internal box 92. Box 90 is comprised of a pair of opposite sidewalls 94, 96, an outer end wall 98, and an inner end wall 100 which together with the upper plate 54 and lower plate 56 define a first subcompartment 102. Inner end wall 100 is provided with an inlet opening 104 which provides fluid communication from the outer spray chamber or cavity 59 to the subcompartment 102.

Second internal box 92 is comprised of a pair of opposite sidewalls 106, 108, an outer end wall 110, and an inner end wall 112 which is provided with an inlet opening 114. These walls provide and define a second subcompartment 116. Additional subcompartments may be added or deleted, and the location of the subcompartments can be varied to achieve the desired fluid pressures at various locations in the wash arm 34. As shown in the drawings, the spray apertures 64, 66, 68 are in communication with the first subcompartment 102, and the spray apertures 76, 78, 80 are in communication with the second subcompartment 116. The restricted sizes of the inlet openings 104, 114, cause the subcompartments 102, 116 to have a reduced fluid pressure therein relative to the fluid pressure which appears in the larger compartment 59. The larger spray chamber or cavity 59 completely surrounds the subcompartments 102, 116 and is in direct communication with the spray apertures 60, 62, 70, 72, 74, 82, and 84. Thus, the spray apertures 70, 72, and 74 which are located very close to the pivotal axis of wash arm 34 are in direct communication with the spray chamber 59. Similarly, the outer most spray apertures 60, 62, 82, and 84 are also in direct communication with the spray chamber or cavity 59. This causes the higher fluid pressure to be located adjacent the outer most edge of the wash arm 34 and adjacent the center of the wash arm, but the lower fluid pressures produced by subcompartments 102, 116 are located intermediate these two extreme areas. This is because in typical dishwashers the cups and glasses which are likely to be moved by high pressure sprays are generally located intermediate the opposite ends of the arms.

The pump 32 is adapted to take in the water or washing fluid 24 through an inlet opening (not shown) and to force the washing fluid to be circulated upwardly through throat 44. Blades (not shown) within the pump 32 impart a rotational motion to the washing fluid as it is forced upwardly through throat 44. This washing fluid exits through apertures 46 in throat 44 and enters the wash arm 34. The rotational movement of the washing fluid imparts a rotation to the wash arm 34 and causes it to rotate within the washing chamber or cavity 22 of the dishwasher. The washing fluid fills the cavity 59 within the wash arm 34 and also fills the subcompartments 102, 116. However, the washing fluid within the subcompartments 102, 116 is at a reduced fluid pressure thereby causing sprays which do not extend as high upwardly as do the sprays exiting through the other apertures 60, 62, 72, 74, 82, 84. The fluid pressure within the subcompartments 102, 114 is controlled primarily by the cross-sectional sizes of the inlet openings 104, 114. The cross-sectional sizes of these two apertures can be varied in order to achieve the desired fluid pressures within subcompartments 102, 116.

The preferred embodiment of the invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit or scope of the invention as further defined in the following claims.

I claim:

1. A spray means adapted to be mounted in a dishwasher and connected to a source of pressurized fluid comprising:

an elongated spray housing having a longitudinal axis and first and second opposite ends, said spray housing having exterior walls forming an enclosed spray chamber therein;

interior wall means forming at least a first subchamber within said spray chamber, said interior wall means having a first subchamber inlet opening providing fluid communication from said spray chamber into said first subchamber;

a first group of spray opening sin said exterior walls of said spray housing providing fluid communication from said spray chamber to the exterior of said spray housing;

a second group of spray openings in said exterior walls of said spray housing providing fluid communication from said first subchamber to the exterior of said spray housing;

said spray housing having a spray chamber inlet means located at the approximate midpoint of said longitudinal axis of said spray housing and being adapted to be connected to said source of pressurized fluid for introducing said pressurized fluid into said spray chamber, whereby a first portion of said fluid will be sprayed at a first pressure through said first group of spray openings and a second portion of said fluid will pass from said spray chamber through said first subchamber inlet opening into said first subchamber and will be sprayed at a second pressure through said second group of spray openings;

said first group of spray openings including an inner spray opening adjacent said spray chamber inlet means and an outer spray opening adjacent said first end of said spray housing, said second group of spray openings being located between said inner and outer spray openings;

said first subchamber inlet opening being sufficiently small in cross section to cause said second pressure to be less than said first pressure.

2. A spray means according to claim 1 wherein said spray housing includes spaced apart top and bottom walls, said interior wall means extending between said top and bottom walls and forming sidewalls for said first subchamber, said spray chamber extending completely around and surrounding said sidewalls of said first subchamber.

3. A spray means according to claim 1 wherein second interior wall means form a second subchamber within said spray chamber, said second interior wall means having a second subchamber inlet opening providing fluid communication from said spray chamber into said second subchamber; a third group of spray openings being in said exterior walls of said spray housing providing communication from said second subchamber to the exterior of said spray housing; said second subchamber inlet opening being sufficiently small in cross section to cause a third fluid pressure less than said first fluid pressure to be formed within said second subchamber in response to the introduction of said pressurized fluid through said spray chamber inlet means into said spray chamber.

4. A spray means according to claim 3 wherein said first subchamber is on opposite sides of said spray chamber inlet means from said second subchamber.

5. In combination:

a spray housing having exterior walls forming a hollow enclosed spray chamber therein;

means for rotating said spray housing about a vertical rotational axis;

first interior wall means forming a first subchamber within said spray chamber, said first interior wall means having a first subchamber inlet opening providing fluid communication from said spray chamber into said first subchamber;

second interior wall means forming a second subchamber within said spray chamber, said second interior wall means having a second subchamber inlet opening providing fluid communication from said spray chamber into said second subchamber: p1 said first and second subchambers being on opposite sides of said vertical rotational axis from one another;

a first group of spray openings in said exterior walls of said spray housing providing fluid communication from said spray chamber to the exterior of said spray housing;

a second group of spray openings in said exterior walls of said spray housing providing fluid communication from said first subchamber to the exterior of said spray housing;

a third group of spray openings in said exterior walls of said spray housing providing fluid communication from said second subchamber to the exterior of said spray housing;

said spray housing having a spray chamber inlet means for receiving pressurized fluid and for introducing said fluid into said spray chamber at a first fluid pressure;

said first and second subchamber inlet openings permitting some of said fluid within said spray chamber to pass into said first and second subchambers, respectively, and being sized so as to cause a reduction of fluid pressure within both of said first and second subchambers from said first fluid pressure within said spray chamber.

6. A combination according to claim 5 wherein said spray housing comprises an elongated arm having first and second opposite ends, said vertical rotational axis of said arm being located intermediate said first and second opposite ends of said arm.

7. An improvement in an article washing appliance having a washing cavity for receiving articles to be washed, pump means for recirculating washing fluid within said cavity, spray means rotatable about a vertical rotational axis and having a hollow spray chamber connected to said pump means for receiving pressurized washing fluid therefrom, said improvement comprising:

first interior wall means within said spray chamber forming at least a first subchamber within said spray chamber, said first interior wall means having a first subchamber inlet opening providing fluid communication from said spray chamber into said first subchamber;

a first group of spray openings providing fluid communication from said spray chamber to the exterior of said spray means and a second group of spray openings providing fluid communication from said first subchamber to the exterior of said spray means;

said first subchamber inlet opening being sized so as to permit said washing fluid to pass from said spray chamber into said first subchamber and to spray outwardly through said second group of spray openings at a pressure less than the pressure at which said washing fluid is sprayed from said spray chamber outwardly through said first group of spray openings;

second interior wall means forming a second subchamber within said spray chamber on the opposite side of said vertical rotational axis of said spray means from said first subchamber, said second interior wall means having a second subchamber inlet opening providing fluid communication from said spray chamber into said second subchamber;

a third group of spray openings in said spray means providing fluid communication from said second subchamber to the exterior of said spray means and into said washing cavity;

said second subchamber inlet opening being sized to permit said washing fluid to pass from said spray chamber into said second subchamber and to spray outwardly through said third group of spray openings at a pressure less than the pressure at which said washing fluid is sprayed from said spray chamber through said first group of spray openings.

8. A sprayer for use in a washing appliance comprising:

a spray housing having spaced apart top and bottom exterior walls and having a hollow enclosed spray chamber therebetween;

means for rotatably mounting said spray housing within said appliance for rotation about a vertical rotational axis;

fluid inlet means for introducing pressurized fluid into said spray chamber;

first interior wall means extending between said top wall and said bottom wall to form a first subchamber therein; said first interior wall means having a first subchamber inlet opening providing fluid communication from said spray chamber to said first subchamber;

second interior wall means extending between said top wall and said bottom wall to form a second subchamber therein, said second interior wall means having a second subchamber inlet opening providing fluid communication from said spray chamber to said second subchamber;

said first and second subchambers being positioned on opposite sides of said rotational axis from one another;

first, second, and third groups of spray openings within said exterior walls of said spray housing providing fluid communication from said spray chamber, said first subchamber, and said second subchamber respectively to the exterior of said spray housing;

said first and second subchamber inlet openings being of a size which restricts flow into said first and second subchambers sufficiently to reduce fluid pressure within said first and second subchambers below the fluid pressure within said spray chamber.

9. A sprayer according to claim 8 wherein said first subchamber inlet opening is of a size different from said second subchamber inlet opening.

10. A sprayer for use in a washing appliance comprising:

a spray housing having exterior walls forming a hollow enclosed spray chamber;

means for rotatably mounting said spray housing within said appliance for rotation about a vertical rotational axis;

fluid inlet means for introducing pressurized fluid into said spray chamber;

first interior wall means forming a first subchamber within said spray chamber, said first interior wall means having a first subchamber inlet opening providing fluid communication from said spray chamber to said first subchamber;

second interior wall means forming a second subchamber within said spray chamber, said second interior wall means having a second subchamber inlet opening providing fluid communication from said spray chamber to said second subchamber;

first, and second groups of spray openings within said exterior walls of said spray housing providing fluid communication from said first subchamber, and said second subchamber respectively to the exterior of said spray housing;

said first subchamber inlet opening being a size different from the size of said second subchamber inlet opening.

11. A spray according to claim 10 wherein said first and second subchambers are positioned on opposite sides of said vertical rotational axis of said spray housing from one another.

12. A spray means adapted to be mounted in a dishwasher and connected to a source of pressurized fluid comprising:

a spray housing having top, bottom and side exterior walls and defining an enclosed spray chamber therein;

interior wall means cooperating with at least a portion of said exterior walls to form at least one enclosed subchamber having subchamber sidewalls, subchamber end walls, a subchamber top wall, and a subchamber bottom wall said spray chamber completely surrounding said subchamber sidewalls and said subchamber end walls of said at least one subchamber;

a first group of spray openings in said exterior walls of said spray housing providing fluid communication from said spray chamber to the exterior of said spray housing;

at least one spray opening in said exterior walls of said spray housing providing fluid communication from said first subchamber to the exterior of said spray housing;

said spray housing having a spray chamber inlet means in fluid communication with said source of pressurized fluid for introducing said pressurized fluid into said spray chamber at a first fluid pressure;

said interior wall means having an inlet opening therein permitting fluid communication from said spray chamber to said at least one subchamber and being sized so as to cause reduction in fluid pressure within said at least one subchamber from said first fluid pressure within said spray chamber, whereby a first portion of said fluid will be sprayed at said first pressure through said first group of spray openings, and a second portion of said fluid will pass form said spray chamber through said first subchamber inlet opening into said first subchamber and will be sprayed at a reduced pressure through said at least one spray opening.

* * * * *